US010203636B1

(12) United States Patent
Inomata

(10) Patent No.: US 10,203,636 B1
(45) Date of Patent: Feb. 12, 2019

(54) FIXING DEVICE AND IMAGE FORMING DEVICE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Toshiya Inomata, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/708,372

(22) Filed: Sep. 19, 2017

(51) Int. Cl.
*G03G 15/20* (2006.01)

(52) U.S. Cl.
CPC ..... *G03G 15/2028* (2013.01); *G03G 15/2085* (2013.01)

(58) Field of Classification Search
CPC ..... G03G 15/2053; G03G 15/2064; G03G 15/2085; G03G 15/2089; G03G 15/2028
See application file for complete search history.

(56) References Cited

U.S. PATENT DOCUMENTS 8,478,177 B2 * 7/2013 Kurita ..... G03G 15/2028 219/216
9,008,558 B2 4/2015 Saito et al.
9,026,024 B2 5/2015 Ogawa et al.

FOREIGN PATENT DOCUMENTS

JP 2008-152021 7/2008

* cited by examiner

*Primary Examiner* — Hoang Ngo
(74) *Attorney, Agent, or Firm* — Amin, Turocy & Watson, LLP

(57) ABSTRACT

A fixing device includes a belt holding member, a fixing belt, a pressing roller, and a peeling member. The pressing roller forms a fixing nip portion through which a recording medium as a fixing target passes between the pressing roller and the fixing belt. The peeling member separates the recording medium having passed through the fixing nip portion from the fixing belt. The peeling member includes a guide wall which guides the recording medium having passed through the fixing nip portion. The guide wall includes a belt facing portion which faces the outer surface of the fixing belt in a non-contact state, and an extending portion which extends to the outside in the width direction of the fixing belt continuously from the belt facing portion. The belt holding member includes an abutting surface which abuts on the extending portion of the end face of the guide wall.

10 Claims, 5 Drawing Sheets

FIXING DEVICE AND IMAGE FORMING DEVICE

FIELD

Embodiments described herein relate generally to a fixing device and an image forming device.

BACKGROUND

An image forming device such as a multi-function peripheral (MFP), a copying machine, or a printer includes a fixing device for fixing a toner image transferred onto a recording medium such as a recording paper.

As a fixing device, there is a fixing device having a structure in which a fixing belt is held from the inside by a heat roller incorporating a heater for fixing a toner and a non-rotating pad material, and a pressing roller is pressed against the pad material with the fixing belt sandwiched therebetween. The fixing belt rotates in a state of being supported by the heat roller and the pad material and heated by the heat roller. Between the pressing roller and the fixing belt, a fixing nip portion through which a recording medium as a fixing target passes is formed. Fixing of the toner to the recording medium is performed while the recording medium passes through the fixing nip portion. Further, on the downstream side (on the downstream side in the conveying direction of the recording medium) of the fixing nip portion, a peeling member for peeling the recording medium having passed through the nip portion from the fixing belt is provided. The peeling member includes a guide wall which guides the recording medium having passed through the fixing nip portion. As the peeling member, there are a peeling member (contact-type) in which an end face on a side closer to the fixing nip portion of the guide wall abuts on the outer surface of the fixing belt and a peeling member (non-contact-type) in which the end face is disposed facing the outer surface of the fixing belt with a small gap therebetween.

However, in the fixing device using the peeling member of a non-contact-type, it is not easy to accurately control the gap between the end face of the guide wall of the peeling member and the outer surface of the fixing belt.

DETAILED DESCRIPTION

Figure 1:
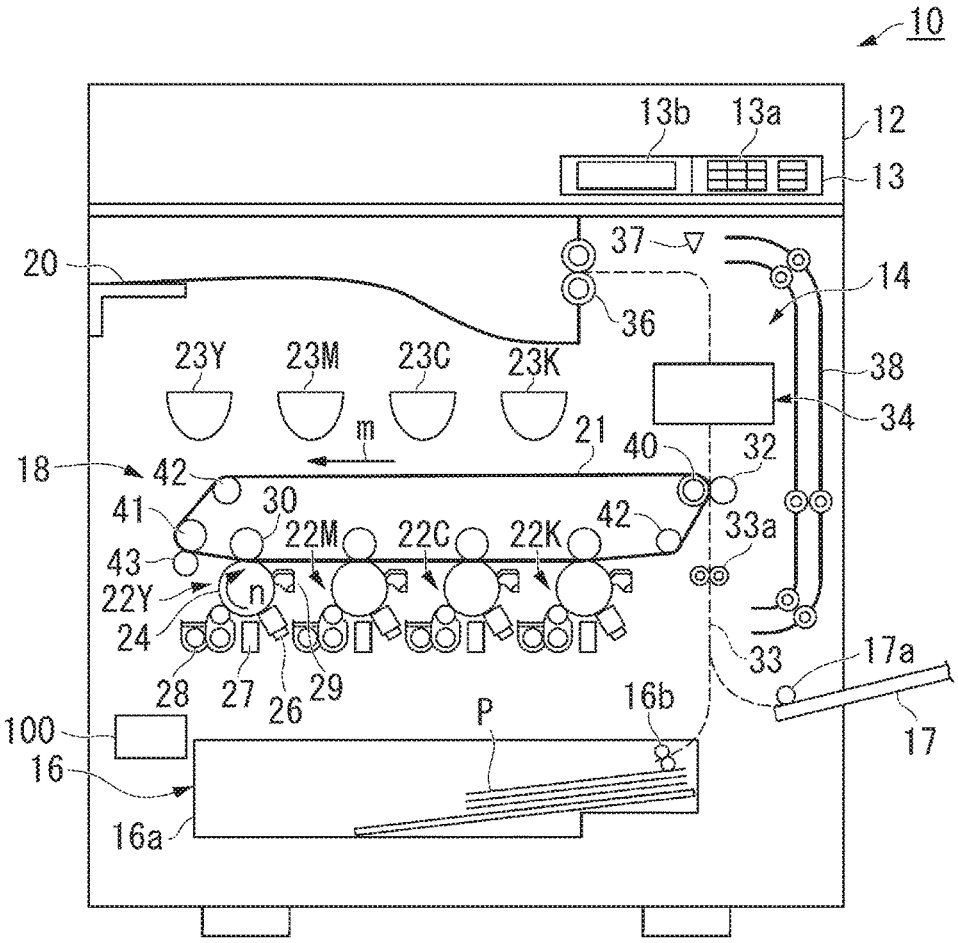
FIG. 1 is a side view of an image forming device including a fixing device according to an embodiment.

In general, a fixing device of an embodiment includes a belt holding member, a fixing belt, a pressing roller, and a peeling member. The fixing belt rotates in a state of being held from the inside by the belt holding member. The pressing roller rotates in an opposite direction to the rotational direction of the fixing belt in a state of being pressed toward the outer surface of the fixing belt. The pressing roller forms a fixing nip portion through which a recording medium as a fixing target passes between the pressing roller and the fixing belt. The peeling member separates the recording medium having passed through the fixing nip portion from the fixing belt. The peeling member includes a guide wall which guides the recording medium having passed through the fixing nip portion. An end face on a side closer to the fixing nip portion of the guide wall includes a belt facing portion which faces the outer surface of the fixing belt in a non-contact state, and an extending portion which extends to the outside in the width direction of the fixing belt continuously from the belt facing portion. The belt holding member includes an abutting surface which abuts on the extending portion of the end face of the guide wall at a position outside the fixing belt in the width direction.

Hereinafter, an image forming device of an embodiment will be described with reference to the drawings. Incidentally, the same reference numerals are assigned to the same components in the respective drawings.

FIG. 1 is a side view showing the entire configuration of an image forming device 10 of an embodiment. For example, the image forming device 10 is a multi-function peripheral. However, the image forming device 10 is not limited to the above-mentioned example, and may be a copying machine, a printer, or the like.

The image forming device 10 includes a scanner portion 12, a control panel 13, a main body portion 14, and a control portion 100. The main body portion 14 includes a paper feed cassette portion 16, a printer portion 18, a fixing device 34, and the like. The control portion 100 controls the whole image forming device 10. For example, the control portion 100 controls the operations of the scanner portion 12, the control panel 13, the paper feed cassette portion 16, the printer portion 18, the fixing device 34, and the like.

The scanner portion 12 reads an original document image. The control panel 13 includes an input key 13*a* and a display portion 13*b*. For example, the input key 13*a* receives input from a user. For example, the display portion 13*b* is a touch panel type. The display portion 13*b* receives input from a user and performs display to the user.

The paper feed cassette portion 16 includes a cassette main body 16*a* and a pickup roller 16*b*. The cassette main body 16*a* stores a sheet P which is a recording medium. The pickup roller 16*b* picks up the sheet P from the cassette main body 16*a*. The sheet P picked up from the cassette main body 16*a* is fed to a conveyance path 33.

The printer portion 18 forms an image. The printer portion 18 performs, for example, image formation of an original document image read by the scanner portion 12. The printer portion 18 includes an intermediate transfer belt 21. In the printer portion 18, the intermediate transfer belt 21 is supported by a backup roller 40, a driven roller 41, and a tension roller 42. The backup roller 40 includes a drive portion (not shown). The printer portion 18 rotates the intermediate transfer belt 21 in the direction of the arrow m.

The printer portion 18 includes four image forming stations 22Y, 22M, 22C, and 22K. The image forming stations 22Y, 22M, 22C, and 22K are provided for forming images of yellow (Y), magenta (M), cyan (C), and black (K), respectively. The image forming stations 22Y, 22M, 22C, and 22K are arranged in parallel along the rotational direction of the intermediate transfer belt 21 on the lower side of the intermediate transfer belt 21.

The printer portion 18 includes cartridges 23Y, 23M, 23C, and 23K above the image forming stations 22Y, 22M, 22C, and 22K, respectively. The cartridges 23Y, 23M, 23C, and 23K store replenishment toners of yellow (Y), magenta (M), cyan (C), and black (K), respectively.

Hereinafter, among the image forming stations 22Y, 22M, 22C, and 22K, the image forming station 22Y for Y (yellow) will be described as an example. Incidentally, the image forming stations 22M, 22C, and 22K have the same configuration as the image forming station 22Y, and therefore, a detailed description will be omitted.

The image forming station 22Y includes an electrifying charger 26, an exposure scanning head 27, a developing device 28, and a photoconductor cleaner 29. The electrifying charger 26, the exposure scanning head 27, the developing device 28, and the photoconductor cleaner 29 are arranged around a photoconductive drum 24 which rotates in the direction of the arrow n.

The image forming station 22Y includes a primary transfer roller 30. The primary transfer roller 30 faces the photoconductive drum 24 through the intermediate transfer belt 21.

The image forming station 22Y exposes the photoconductive drum 24 to light by the exposure scanning head 27 after electrifying the photoconductive drum 24 by the electrifying charger 26. The image forming station 22Y forms an electrostatic latent image on the photoconductive drum 24. The developing device 28 develops the electrostatic latent image on the photoconductive drum 24 using a two-component developer formed of a toner and a carrier.

The primary transfer roller 30 primarily transfers a toner image formed on the photoconductive drum 24 to the intermediate transfer belt 21. The image forming stations 22Y, 22M, 22C, and 22K form a color toner image on the intermediate transfer belt 21 by the primary transfer roller 30. The color toner image is formed by sequentially superimposing the toner images of yellow (Y), magenta (M), cyan (C), and black (K). The photoconductor cleaner 29 removes the toner remaining on the photoconductive drum 24 after primary transfer.

The printer portion 18 includes a secondary transfer roller 32. The secondary transfer roller 32 faces the backup roller 40 through the intermediate transfer belt 21. The secondary transfer roller 32 secondarily transfers the color toner image on the intermediate transfer belt 21 to the sheet P collectively. The sheet P is fed from the paper feed cassette portion 16 or a manual paper feed tray 17 along the conveyance path 33.

The printer portion 18 includes a belt cleaner 43 facing the driven roller 41 through the intermediate transfer belt 21. The belt cleaner 43 removes the toner remaining on the intermediate transfer belt 21 after secondary transfer.

In the conveyance path 33, a resist roller 33*a*, the fixing device 34, and a paper discharge roller 36 are provided. On the downstream side of the fixing device 34 in the conveyance path 33, a branch portion 37 and a reversal conveyance portion 38 are provided. The branch portion 37 sends the sheet P after fixing to a paper discharge portion 20 or the reversal conveyance portion 38. In the case of both-side printing, the reversal conveyance portion 38 reverses and conveys the sheet P sent from the branch portion 37 to a direction of the resist roller 33*a*. The image forming device 10 forms the toner image on the sheet P by the printer portion 18 and discharges the sheet P to the paper discharge portion 20.

Incidentally, the image forming device 10 is not limited to a tandem developing system, and the number of developing devices 28 is also not limited. Further, the image forming device 10 may directly transfer the toner image to the sheet P from the photoconductive drum 24.

Hereinafter, the fixing device 34 will be described in detail.

Figure 2:
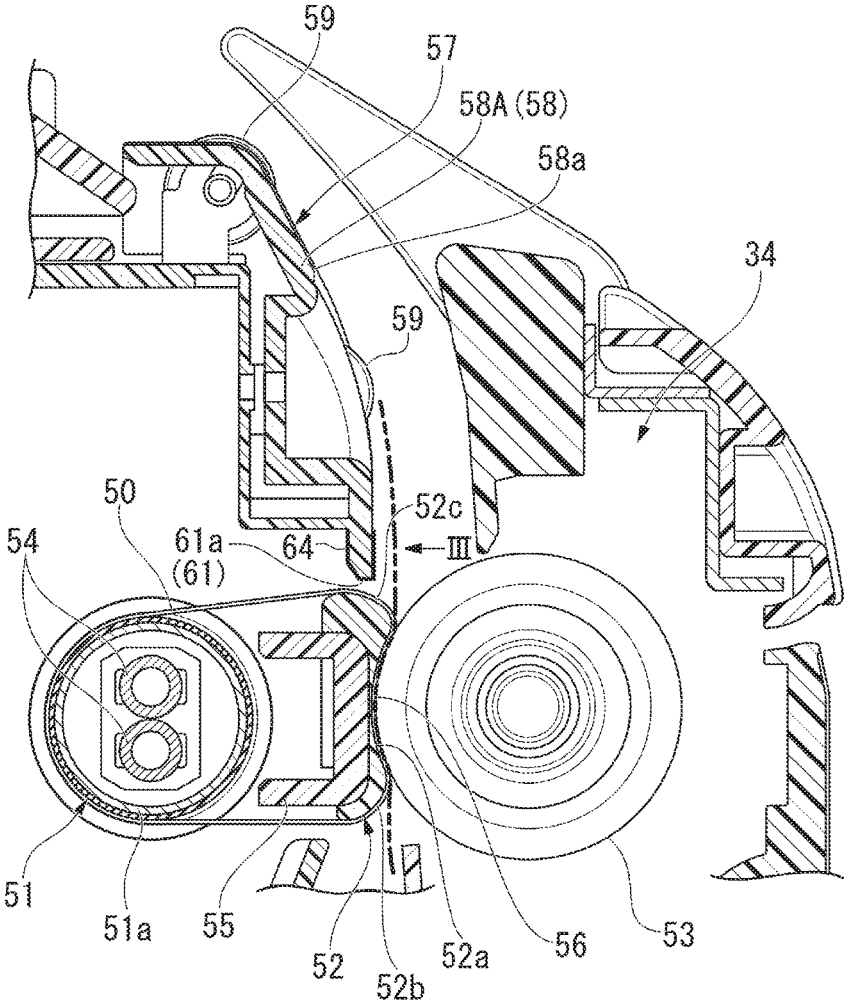
FIG. 2 is a cross-sectional view taken along the II-II line of FIG. 3 of the fixing device.
Figure 3:
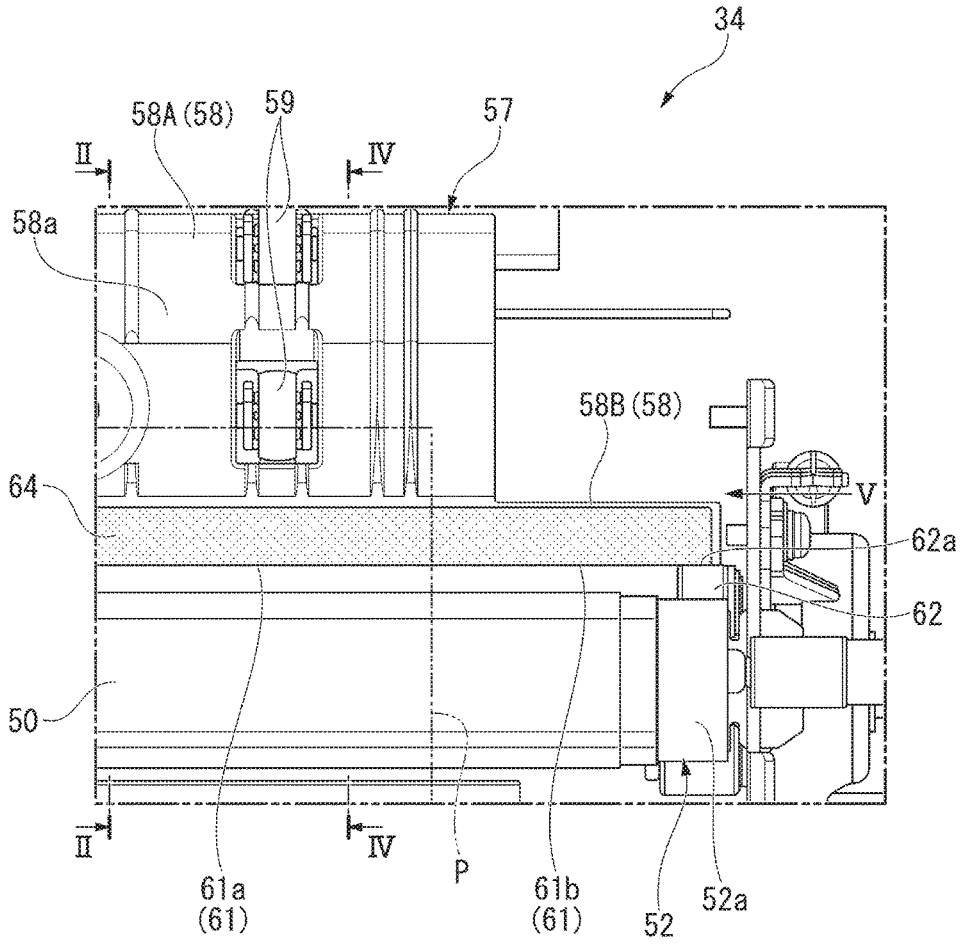
FIG. 3 is a front view corresponding to a III arrow view of FIG. 2 of the fixing device.
Figure 4:
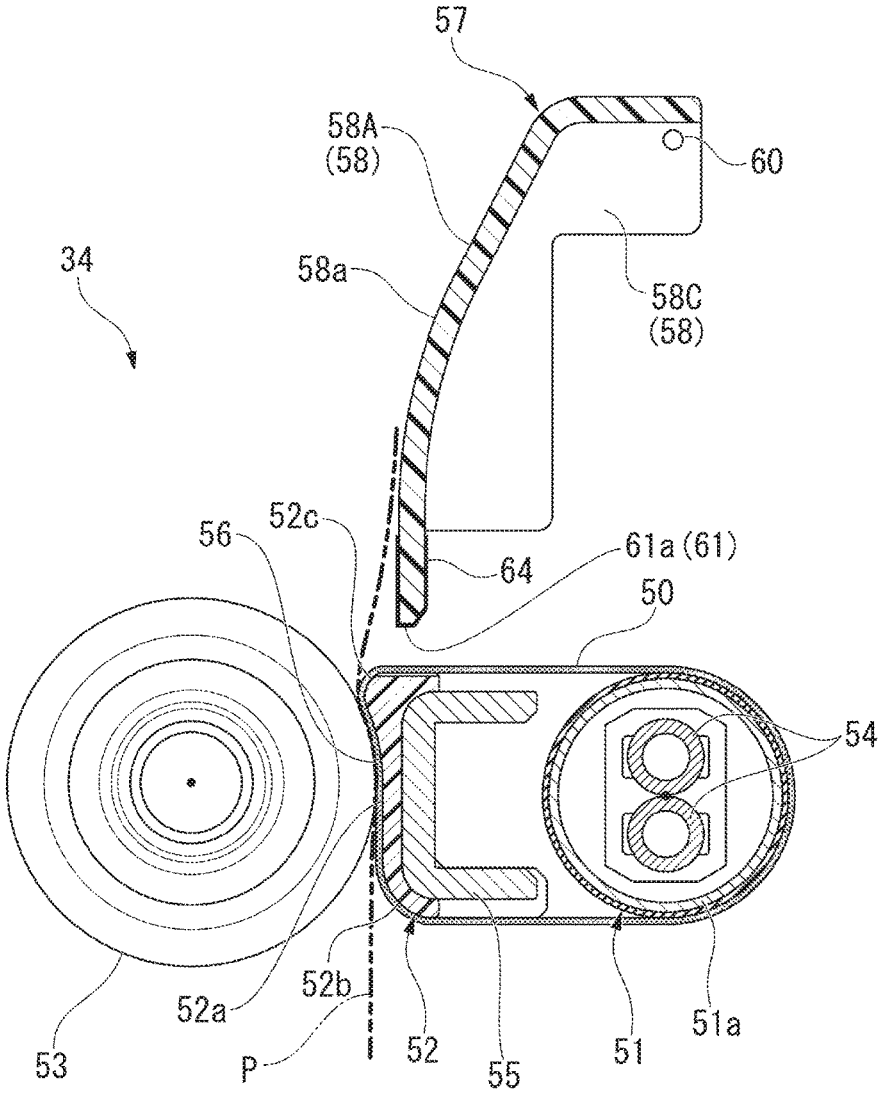
FIG. 4 is a cross-sectional view taken along the IV-IV line of FIG. 3 of the fixing device.
Figure 5:
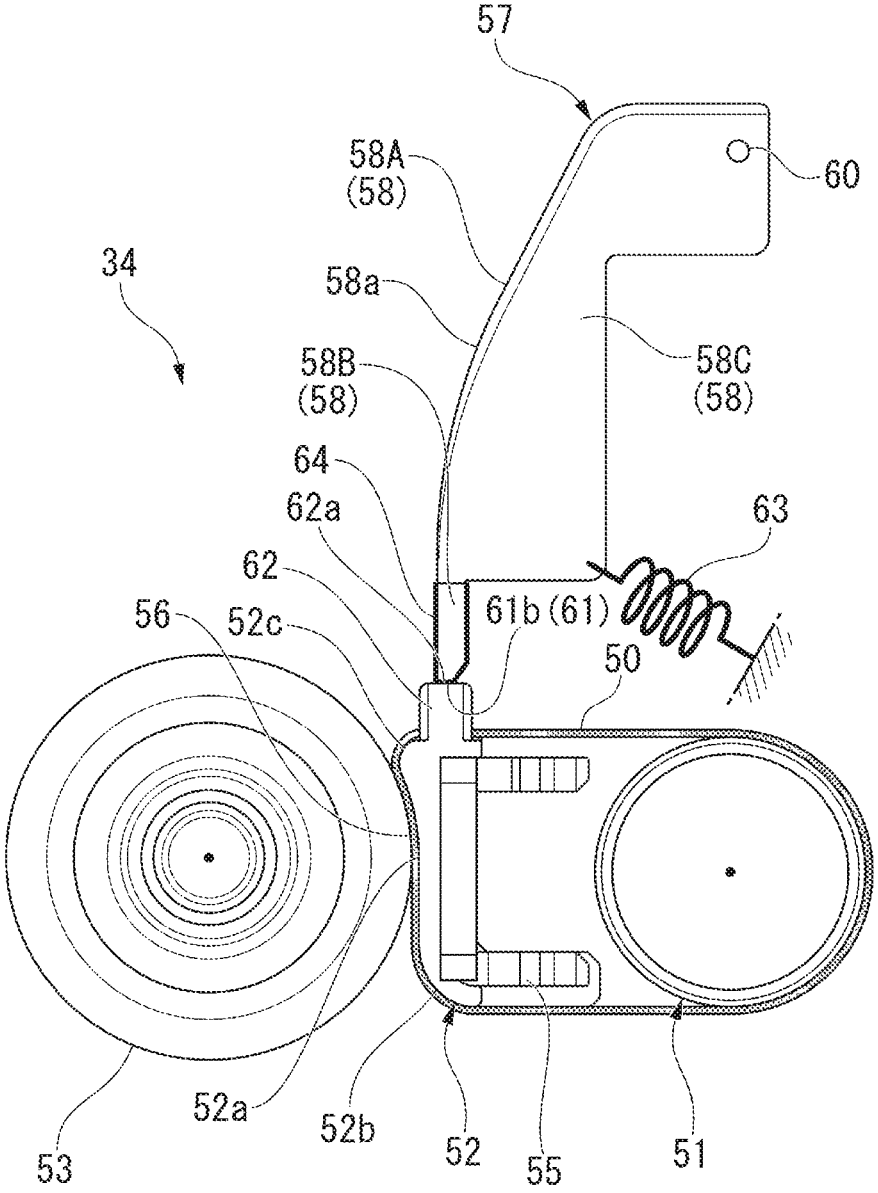
FIG. 5 is a side view corresponding to a V arrow view of FIG. 3 of the fixing device.

FIG. 2 is a view showing a cross section taken along the II-II line of FIG. 3 of the fixing device 34. FIG. 3 is a front view corresponding to a III arrow view of FIG. 2 of the fixing device 34. FIG. 4 is a view showing a cross section taken along the IV-IV line of FIG. 3 of the fixing device 34. FIG. 5 is a side view corresponding to a V arrow view of FIG. 3 of the fixing device 34.

The fixing device 34 includes a fixing belt 50 which is a rotating endless belt, a heat roller 51 which holds the fixing belt 50 from the inside, a pad material 52, and a pressing roller 53 which is pressed against the outer surface of the pad material 52 through the fixing belt 50.

The heat roller 51 houses a halogen heater 54 which is a heating source inside a core metal 51*a* in a cylindrical shape. The halogen heater 54 transmits heat to the outer surface side of the heat roller 51, and heats the fixing belt 50 by the heat. A portion heated by the heat roller 51 of the fixing belt 50 moves to the support portion by the pad material 52 due to the rotational movement of the fixing belt 50. In the vicinity of the outer circumference of the heat roller 51 sandwiching the fixing belt 50, a temperature sensor (not shown) is provided. A detection signal of the temperature sensor is output to an output control portion of the halogen heater 51. The output control portion controls the halogen heater 51 so that the temperature of the fixing belt 50 is maintained at an appropriate temperature.

Incidentally, the heating source which heats the fixing belt 50 is not limited to the halogen heater 51, and may be, for example, an electromagnetic induction heater, a carbon heater, or the like.

The heat roller 51 is supported by a frame member (not shown) of the image forming device 10 through a drive motor (not shown) and a bearing (not shown). The drive motor rotates the heat roller 51 in the opposite direction to the driving rotational direction of the pressing roller 53. However, the heat roller 51 is driven at a rotational speed which is slightly slower than the pressing roller 53.

The pad material 52 is formed of a hard resin material and is held by a stay 55 made of a metal. The stay 55 is supported by a frame member (not shown) of the image forming device 10. The pad material 52 extends in a direction along the width direction of the fixing belt 50. The pad material 52 is disposed at a position separated from the heat roller 51 to the pressing roller 53 side.

On a side facing the pressing roller 53 of the pad material 52, a concave portion 52*a* having an arc surface substantially along the outer surface of the pressing roller 53 is formed. On the lower side of the concave portion 52*a* of the pad material 52 (on the side from which the sheet P is conveyed), a first curved portion 52*b* which is gently curved in the direction of the heat roller 51 is formed. Further, on the upper side of the concave portion 52*a* of the pad material 52 (on the side to which the sheet P is conveyed), a second curved portion 52*c* which is curved in the direction of the heat roller 51 more steeply than the first curved portion 52*b* is formed.

The fixing belt 50 is hung on the heat roller 51 and the pad material 52. The heat roller 51 and the pad material 52 are formed longer than the width of the fixing belt 50. The fixing belt 50 abuts on the outer circumferential surface of the pressing roller 53 in the concave portion 52*a* of the pad material 52. The pressing roller 53 is rotationally operated by a drive motor (not shown). The fixing belt 50 receives a rotational force from the pressing roller 53 in the concave portion 52*a* of the pad material 52, and rotates in an opposite direction to the rotational direction of the pressing roller 53. At this time, the fixing belt 50 slides on the outer surface of the pad material 52.

Further, between the fixing belt 50 located at a position facing the concave portion 52*a* of the pad material 52 and the outer circumferential surface of the pressing roller 53, a fixing nip portion 56 which allows the sheet P to pass therethrough is formed. The sheet P passing through the fixing nip portion 56 is pressed by being sandwiched between the pad material 52 and the pressing roller 53, and also thermal energy is applied thereto by the fixing belt 50 heated by the heat roller 52. The toner image formed on the sheet P is fixed on the sheet P in the meantime.

Further, the fixing device 34 includes a peeling member 57 which separates the sheet P having passed through the fixing nip portion 56 from the fixing belt 50 on the upper side of the fixing nip portion 56 (on the downstream side in the conveying direction of the sheet P).

The peeling member 57 includes a guide wall 58 made of a resin which guides the sheet P having passed through the fixing nip portion 56. The guide wall 58 has a guide surface 58*a* convexly curved in a side view. The guide surface 58*a* comes into contact with the sheet P having passed through the fixing nip portion 56 and guides the sheet P. Further, a guide roller 59 which can rotate is held at an appropriate position of the guide wall 58. The sheet P is also guided by the guide roller 59.

The guide wall 58 includes a guide main body portion 58A having a substantially constant width, and a side part piece 58B linearly extending to the outside in the width direction from the right and left side portions of a lower end of the guide main body portion 58A (an end portion on a side closer to the fixing nip portion 56 of the guide main body portion 58A). Further, a side wall portion 58C is provided so as to be bent at a substantially right angle in a region on the upper side of the side part piece 58B in the right and left side portions of the guide main body portion 58A. A region in the vicinity of an upper end portion of each of the right and left side wall portions 58C is swingably supported by the frame member (not shown) of the image forming device 10 through a rotary shaft 60.

An end face 61 on the lower side of the guide wall 58 (an end face on a side closer to the fixing nip portion 56 of the guide wall 58) has a belt facing portion 61*a* which faces the outer surface of the fixing belt 50 in a non-contact state and an extending portion 61*b* which extends to the outside in the width direction of the fixing belt 50 from both right and left sides of the belt facing portion 61*a* at a position above the pad material 52. The belt facing portion 61*a* and the extending portion 61*b* of the end face 61 of the guide wall 58 are formed by planes which are continuous and flush with each other. The belt facing portion 61*a* is disposed in the guide main body portion 58A of the guide wall 58, and the extending portion 61*b* is mainly disposed in the right and left side part pieces 58B of the guide wall 58.

Here, the pad material 52 which holds the fixing belt 50 from the inside includes an extending portion 52*a* which extends to the outside in the width direction of the right and left end portions of the fixing belt 50. On the upper surface side of this extending portion 52*a*, a convex portion 62 is integrally formed. The convex portion 62 protrudes to the upper side of the fixing belt 50 held on the pad material 52 in a predetermined amount. On the upper surface of the convex portion 62, a flat abutting surface 62*a* is formed. On the abutting surface 62*a*, the extending portion 61*b* of the end face 61 of the peeling member 57 abuts.

Further, as shown in FIG. 5, to the guide wall 58 of the peeling member 57, one end portion of a spring 63 which rotationally biases a lower end side of the guide wall 58 downward is connected. The other end portion of the spring 63 is connected to another fixing member such as the frame member. The spring 63 allows the extending portion 61*b* of the end face 61 of the guide wall 58 to abut on the abutting surface 62*a* on the pad member 52 side by applying a biasing force to the guide wall 58.

Further, to a lower edge of the guide main body portion 58A of the guide wall 58 and a laterally extending portion 58, an antifouling sheet 64 such as a fluororesin tape is attached so as to cover a front and back surface of the end face 61 (the belt facing portion 61*a* and the extending portion 61*b*) on the lower side. By covering the lower edge of the guide wall 58 with the antifouling sheet 64, adhesion of a foreign substance such as the toner is prevented. The antifouling sheet 64 is also attached so as to cover the extending portion 61*b* continuously as well as the belt facing portion 61*a* of the end face 61 of the guide wall 58. Due to this, the extending portion 61*b* of the end face 61 of the guide wall 58 abuts on the abutting surface 62*a* through the antifouling sheet 64.

In the fixing device 34 of the embodiment, the end face 61 of the guide wall 58 of the peeling member 57 is provided with the belt facing portion 61*a* facing the outer surface of the fixing belt 50 in a non-contact state and the extending portion 61*b* extending to the outside in the width direction of the fixing belt 50 so as to be continuously flush with the belt facing portion 61*a*. Then, in the fixing device 34, the extending portion 61*b* of the end face 61 of the guide wall 58 abuts at a position outside the fixing belt 50 in the width direction on the abutting surface 62*a* of the pad material 52 which is the belt holding member. Therefore, in the fixing device 34 of the embodiment, the gap between the end face 61 of the guide wall 58 of the peeling member 57 and the outer surface of the fixing belt 50 can be accurately controlled.

Further, in the fixing device 34 of the embodiment, the extending portion 61*b* of the end face 61 of the guide wall 58 of the peeling member 57 is provided on both right and left sides of the guide wall 58, and the extending portions 61*b* on both right and left sides abut similarly on the corresponding right and left abutting surfaces 62*a* of the pad material 52. Due to this, the gap between the end face 61 of the guide wall 58 and the outer surface of the fixing belt 50 can be stably maintained constant.

Further, in the fixing device 34 of the embodiment, the guide wall 58 of the peeling member 57 includes the guide main body portion 58A having a substantially constant width and the side part piece 58B extending to the outside in the width direction from the end portion on the lower side of the guide main body portion 28A. Then, in the fixing device 34, the belt facing portion 61*a* of the end face 61 on the lower side of the guide wall 58 is provided in the guide main body portion 28A, and the extending portion 61*b* of the end face 61 on the lower side of the guide wall 58 is mainly provided in the side part piece 58B. Due to this, in the fixing device 34 of the embodiment, it is only necessary to provide the side part piece 58B with a small height for providing the extending portion 61*b* which abuts on the abutting surface 62*a* on the pad material 52 side. Therefore, when adopting this configuration, the size and weight of the peeling member 57 can be reduced.

However, in the above-mentioned embodiment, the side part piece 58B with a small height is continuously provided in the side portion on the lower side of the guide main body portion 28A, however, the entire region of the guide wall 58 may be formed to have a substantially constant width so as to reach the position of the abutting surface 62*a*. In this case, the extending portion 61*b* of the end face 61 which abuts on the abutting surface 62*a* is formed in the side end portion of the guide main body portion 28A. When adopting this configuration, the structure of the peeling member 57 can be simplified.

Further, in the fixing device 34 of the embodiment, the abutting surface 62*a* is integrally formed with the pad material 52 which directly holds the fixing belt 50 from the inside in a non-rotating state. Due to this, the gap between the outer surface of the fixing belt 50 and the end face 61 of the guide wall 58 can be controlled with a small error. Further, when forming the pad material 52 using a resin material, the convex portion 62 and the abutting surface 62*a* can be easily formed on the pad material 52.

However, the abutting surface 62*a* may be provided on a fixing metal fitting or the like without limiting to the pad material 52 because the pad material 52 is attached to another fixing member such as the stay 55.

Further, in the fixing device 34 of the embodiment, a part at a position separated from the end face 61 on the lower side of the peeling member 57 is swingably supported by a fixing member such as a frame member, and the peeling member 57 is biased by the spring 63 in a direction in which the extending portion 61*b* of the end face 61 on the lower side is abutted on the abutting surface 62*a*. When adopting this configuration, although the configuration is simple, the gap between the end face 61 of the guide wall 58 and the outer surface of the fixing belt 50 can always be maintained constant.

However, the peeling member 57 may be locked to the pad material 52 by a locking member in a state where the extending portion 61*b* of the end face 61 on the lower side is abutted on the abutting surface 62*a* of the pad material 52 by allowing the fixing member to swingably support the peeling member 57 in the same manner as the above-mentioned embodiment.

Further, in the fixing device 34 of the embodiment, the antifouling sheet 64 is attached so as to cover the lower edge of the guide wall 58 of the peeling member 57, so that the belt facing portion 61*a* and the extending portion 61*b* of the end face 61 on the lower side of the guide wall 58 are continuously covered with the antifouling sheet 64. Due to this, the extending portion 61*b* of the end face 61 of the guide wall 58 abuts on the abutting surface 62 of the pad material 52 through the antifouling sheet 64. Therefore, when adopting this configuration, the distance from the upper surface of the fixing belt 50 to the antifouling sheet 64 of the end face 61 of the guide wall 58 can be accurately controlled.

According to at least one embodiment described above, in the fixing device using a non-contact-type peeling member, the gap between the end face of the guide wall of the peeling member and the outer surface of the fixing belt can be accurately controlled.

What is claimed is:

1. A fixing device, comprising:

a belt holding member;

a fixing belt which rotates in a state of being held from the inside by the belt holding member;

a pressing roller which is pressed toward the outer surface of the fixing belt, and also forms a fixing nip portion through which a recording medium as a fixing target passes between the pressing roller and the fixing belt; and a peeling member which separates the recording medium having passed through the fixing nip portion from the fixing belt, wherein the peeling member includes a guide wall which guides the recording medium having passed through the fixing nip portion, an end face on a side closer to the fixing nip portion of the guide wall includes a belt facing portion which faces the outer surface of the fixing belt in a non-contact state, and an extending portion which extends to the outside in the width direction of the fixing belt continuously from the belt facing portion, the belt holding member includes an abutting surface which abuts on the extending portion of the end face of the guide wall at a position outside the fixing belt in the width direction, and the belt holding member includes a pad material which holds the fixing belt from the inside in a non-rotating state, the pad material comprising a concave portion which is an arc surface substantially along the outer surface of the pressing roller.

2. The device according to claim 1, wherein the extending portion is provided on both sides in the width direction of the guide wall.

3. The device according to claim 1, wherein the guide wall includes a guide main body portion having a substantially constant width and a side part piece extending to the outside in the width direction from an end portion on a side closer to the fixing nip portion of the guide main body portion, and the belt facing portion of the end face of the guide wall is provided in the guide main body portion, and the extending portion of the end face of the guide wall is mainly provided in the side part piece.

4. The device according to claim 1, wherein the entire region of the guide wall is formed to have a substantially constant width so as to reach the position of the abutting surface.

5. The device according to claim 1, wherein the abutting surface is integrally formed with the pad material.

6. The device according to claim 1, wherein the belt holding member includes a fixing metal fitting with which the pad material is fixed, and the abutting surface is integrally formed with the fixing metal fitting.

7. The device according to claim 1, wherein in the peeling member, a part separated from the end face of the guide wall is swingably supported by another fixing member, and also is biased by a spring in a direction in which the extending portion is abutted on the abutting surface.

8. The device according to claim 1, wherein in the peeling member, a part separated from the end face of the guide wall is swingably supported by another fixing member, and also is locked by a locking member to the belt holding member in a state where the extending portion is abutted on the abutting surface.

9. A fixing device, comprising:

a belt holding member;

a fixing belt which rotates in a state of being held from the inside by the belt holding member;

a pressing roller which is pressed toward the outer surface of the fixing belt, and also forms a fixing nip portion through which a recording medium as a fixing target passes between the pressing roller and the fixing belt; and a peeling member which separates the recording medium having passed through the fixing nip portion from the fixing belt, wherein the peeling member includes a guide wall which guides the recording medium having passed through the fixing nip portion, an end face on a side closer to the fixing nip portion of the guide wall includes a belt facing portion which faces the outer surface of the fixing belt in a non-contact state, and an extending portion which extends to the outside in the width direction of the fixing belt continuously from the belt facing portion, the belt holding member includes an abutting surface which abuts on the extending portion of the end face of the guide wall at a position outside the fixing belt in the width direction, an antifouling sheet is attached so as to cover an edge portion including the belt facing portion of the end face of the guide wall, and the antifouling sheet is also attached so as to cover the extending portion continuously from the belt facing portion.

10. An image forming device, comprising:

a printer portion which transfers a toner image onto a recording medium; and a fixing device which fixes a toner by applying energy to the recording medium having the toner image transferred thereonto, wherein the fixing device includes a belt holding member, a fixing belt which rotates in a state of being held from the inside by the belt holding member, a pressing roller which is pressed toward the outer surface of the fixing belt, and also forms a fixing nip portion through which a recording medium as a fixing target passes between the pressing roller and the fixing belt, and a peeling member which separates the recording medium having passed through the fixing nip portion from the fixing belt, wherein the peeling member includes a guide wall which guides the recording medium having passed through the fixing nip portion, an end face on a side closer to the fixing nip portion of the guide wall includes a belt facing portion which faces the outer surface of the fixing belt in a non-contact state, and an extending portion which extends to the outside in the width direction of the fixing belt continuously from the belt facing portion, the belt holding member includes an abutting surface which abuts on the extending portion of the end face of the guide wall at a position outside the fixing belt in the width direction, and the belt holding member includes a pad material which holds the fixing belt from the inside in a non-rotating state, the pad material comprising a concave portion which is an arc surface substantially along the outer surface of the pressing roller.

* * * * *